US008664557B2

(12) United States Patent
Yang

(10) Patent No.: US 8,664,557 B2
(45) **Date of Patent: *Mar. 4, 2014**

(54) ZIPPER SWITCH LAMPHOLDER

(71) Applicant: Rich Brand Industries Limited, Dongguan (TW)

(72) Inventor: Wen Ho Yang, Tainan (TW)

(73) Assignee: Rich Brand Industries Limited, Dongguan, Guangdong Province (CN)

( * ) Notice: Subject to any disclaimer, the term of this patent is extended or adjusted under 35 U.S.C. 154(b) by 0 days.

This patent is subject to a terminal disclaimer.

(21) Appl. No.: 13/687,190

(22) Filed: Nov. 28, 2012

(65) Prior Publication Data

US 2013/0084750 A1 Apr. 4, 2013

Related U.S. Application Data

(63) Continuation-in-part of application No. 13/221,963, filed on Aug. 31, 2011, now Pat. No. 8,610,016.

(51) Int. Cl.
*H01H 15/00* (2006.01)

(52) U.S. Cl.
USPC ..... 200/543

(58) Field of Classification Search
USPC ..... 200/537, 543–546, 51.15, 11 A, 413, 200/418, 420, 331
See application file for complete search history.

(56) References Cited

U.S. PATENT DOCUMENTS 2,283,405 A * 5/1942 Atterbury ..... 439/703

* cited by examiner

*Primary Examiner* — Edwin A. Leon
*Assistant Examiner* — Anthony R. Jimenez
(74) *Attorney, Agent, or Firm* — Bacon & Thomas, PLLC

(57) ABSTRACT

The present invention provides a zipper switch lampholder having a zipper and a rotating conductive rod, and both ends of the rotating conductive rod can jump between a slope with a first conductive plate and a second conductive plate and a slope without the first conductive plate and the second conductive plate to achieve an operation of switching a light emitting element to be turned on and off, and a plurality of hooks is provided for securely connecting a power line for a wire connection in order to waive the complicated process of tying an UL knot and provide a quicker, more convenient and secured wire connection.

4 Claims, 6 Drawing Sheets

ZIPPER SWITCH LAMPHOLDER

CROSS REFERENCE TO RELATED APPLICATIONS

This application is a continuation-in-part of U.S. patent application Ser. No. 13/221,963, entitled "Plug Wire Type Zipper Switch Lampholder" and filed on Aug. 31, 2011.

BACKGROUND OF THE INVENTION

1. Field of the Invention

The present invention relates to a zipper switch lampholder, and more particularly to the zipper switch lampholder that uses a zipper to pull a rotating conductive rod to rotate directly, such that both ends of the rotating conductive rod can jump between a slope with the conductive plate and a slop without the conductive plate to achieve the effect of switching a light emitting element on and off; and a plurality of hooks for connecting a power line during a wire connection to avoid tying an UL knot.

2. Description of the Related Art

With reference to FIG. 1 for a conventional zipper switch lampholder 1, the conventional zipper switch lampholder 1 comprises a cylindrical shell 11, an insulating plate 12, an insulating base 13 and a zipper switch 14, wherein the cylindrical shell 11 is electrically conductive and provided for screwing and connecting a light emitting element such as a light bulb (not shown in the figure), and a first electrode of the light emitting element is contacted with the cylindrical shell 11 to electrically couple to a negative electrode of the power supply such as a utility power supply (not shown in the figure) . The insulating plate 12 is installed between the cylindrical shell 11 and the insulating base 13, and the zipper switch 14 is installed in the insulating base 13, and a zipper 142 is coupled through a trumpet base 141 on a side and provided for pulling; the insulating base 13 has a plurality of plug slots 131 formed on an outer surface of the insulating base 13 and provided for plugging both bare ends of a power line 15 into two of the plug slots 131 respectively, and each plug slot 131 has a conductive plate (not shown in the figure) installed therein and provided for clamping the bare end of the power line 15 for an electric connection; the conductive plates conduct power supplied from the power line 15 to the switch 14, and then users can pull the zipper 142 manually to control the switch 14 for a switching operation and turn ON or OFF the power source for lighting up the light emitting element or shutting down the light emitting element respectively.

The connection between the zipper switch lampholder 1 and the power line 15 simply relies on the conductive plate installed inside each plug slot 131 to connect each respective bare end of the power line 15, so that when the power line 15 is pulled by an external force intentionally or unintentionally during use, the bare ends of the power line 15 may be detached from the conductive plates to result in a circuit disconnection. To prevent this problem, a conventional zipper switch lampholder 1 generally has an UL knot 151 tied at a position near the bare end of power line 15, and then both bare ends are plugged into two plug slots 131 respectively to achieve the effect of increasing the tensile resistance between the switch lampholder 1 and the power line 15.

The conventional zipper switch lampholder 1 has the drawbacks of a complicated internal structure, a difficult assembling process, and a high manufacturing cost of the switch 14. In particular, the conventional zipper switch lampholder 1 requires the process of tying an UL knot at a position near the bare end of the power line 15, not only increasing the manufacturing time and cost, but also affects the storage and transportation costs since the UL knot 151 has a relatively large volume and the total volume of the switch lampholder 1 cannot be reduced easily due to the volume of the UL knot 151. Further, the UL knot can only passively increase the tensile resistance between the switch lampholder 1 and the power line 15, but it cannot assure the effect of preventing the power line 15 from being loosened or separated from the switch lampholder 1.

SUMMARY OF THE INVENTION

In view of the aforementioned problems and drawbacks of manufacturing and using the conventional zipper switch lampholder, the inventor of the present invention based on years of experience in the related industry, and finally designed the present invention to overcome the aforementioned drawbacks.

Therefore, the present invention provides a zipper switch lampholder that uses a zipper to pull a rotating conductive rod indirectly, such that both ends of the rotating conductive rod can jump between a slope having a conductive plate and a slope without the conductive plate, so as to achieve the effects of switching ON and OFF a light emitting element easily and fixing the power line for a wire connection conveniently.

To achieve the aforementioned objective, the present invention provides a zipper switch lampholder, comprising:

a housing with an open top and an open bottom, and a connecting portion disposed at a top edge of the housing; an operating member, having a switch mechanism installed therein; a cylindrical shell, screwed and coupled to the bottom of the operating member and jointly contained in a housing, and the cylindrical shell bottom having an open bottom and a vertical wall which is a threaded casing provided for screwing and connecting a connector of a light emitting element, and a plate being installed separately on both sides of a vast majority of the open top, and each plate having a penetrating hole formed thereon; a trumpet base, having a connecting hole, fixed to an operating member and protruded towards the outside; a zipper, coupled into the operating member, and drooped outwardly from the trumpet base; and a cap, having an open bottom, a connecting portion formed at a bottom edge of the cap and coupled to the connecting portion at the top of the housing, a slot formed downwardly on a side of the periphery for passing the trumpet base out of the slot, and a through hole formed at the top for passing the power line and electrically coupling the operating member for an electric connection; characterized in that the operating member comprises:

an upper cover, having a plurality of plug wire holes, a plurality of connecting holes and a plurality of hooks disposed at the top of the upper cover, and a middle containing groove, a positioning cavity and a plurality of plate slots interconnected to the plug wire holes at the bottom of the upper cover, wherein a connecting hole is provided for precisely aligning the connecting hole of the trumpet base, and a connecting element is passed for a connection, such that the trumpet base is fixed to and protruded outwardly from the upper cover, and the plug wire holes are provided for plugging the bare ends of the power line respectively, and hooks disposed near the plug wire holes are provided for connecting the power line;

a lever, having a main body and a plurality of turned blocks with a slope and formed on slopes at the periphery of the top of the main body, an axial column vertically erected from the center, a containing groove formed at the bottom and penetrated upwardly to the top and a transverse groove penetrated transversally; an axial column, disposed at a position corresponding to a middle containing groove of the upper cover;

a turning disk, with a dial block formed on a side, and a passing hole formed at the middle, for sheathing on the axial column of the lever, and a clamp groove formed on the other side for passing an inner end of the zipper through the trumpet base to achieve a clamping effect;

a torque elastic element, together with a passing hole of the turning disk being jointly sheathed on the axial column of the lever, and then an end of the axial column being inserted and installed into the middle containing groove of the upper cover, and an end of the torque elastic element abutting the turning disk, and the other end abutting a positioning cavity of the upper cover for a positioning effect; an elastic element, contained in the containing groove of the lever;

a rotating conductive rod, being substantially a column shape, such that the rotating conductive rod compresses the elastic element to retract into the containing groove to accommodate the rotating conductive rod into the transverse groove and rotated with the lever;

the main body, having a plurality of long groove formed at positions corresponding to the plate slots and the plug wire holes of the upper cover, and a connecting hole being formed at a position proximate to the bottom of the long groove; the connecting hole and the plurality of fixing holes being formed at the periphery of the main body; after the rotating conductive rod compresses the elastic element to retract into the containing groove of the lever, and the rotating conductive rod is received into the transverse groove of the lever, the bottom of the lever together with the rotating conductive rod are jointly inserted into the middle space inside the main body; the main body includes a plurality of slopes formed around the middle space; the main body is covered by the upper cover, such that another connecting hole of the upper cover is aligned with one of the fixing holes and a connecting element is provided for the fixation;

a plurality of clamp plates, being contained in the long groove, and the top end being bent and abutted into the plate slot of the upper cover for plugging the bare end of the power line into the plug wire hole, and the bottom end being bent in an opposite direction, and having a penetrating hole attached onto a connecting hole, and then a plurality of connecting elements being passed for the connection;

a first conductive plate, being an oblique plate, and having a penetrating hole formed on a side, so that the top of the main body is attached onto the connecting hole, and then a connecting element being passed for the connection, and the position of the oblique plate being aligned towards the center of the main body and abutted against one of the slopes with an inclination;

a second conductive plate, being an oblique plate, having a penetrating hole formed on a side, and clamped between the penetrating hole of one of the clamp plates and the connecting hole, and the connecting element being passed for the connection, such that the clamp plate and the second conductive plate are always electrically conducted, and the oblique portion of the second conductive plate is tilted towards the center of the main body and abutted against another slope obliquely; and a third conductive plate, being a double-bent plate, and having a penetrating hole, and a connecting hole attached onto the bottom of the main body to align precisely with the penetrating hole of the first conductive plate with the connecting hole in between, and then the connecting element being passed for a fixed connection, so that the third conductive plate and the first conductive plate are always electrically conducted;

when the top of the cylindrical shell is attached onto the bottom of the main body, the penetrating hole formed at the top of the cylindrical shell is aligned precisely with one of the connecting holes and one of the fixing holes, and one of the penetrating holes is passed through the connecting element of the penetrating hole of one of the clamp plates and the connecting hole and the penetrating hole for a fixed connection, such that the cylindrical shell and the clamp plate are always electrically conducted with each other; and after another penetrating hole is aligned precisely with the fixing hole, a connecting element is passed for a secured connection, so as to complete assembling the cylindrical shell with the main body; and a bent protruding position of the third conductive plate remains in the open space at the top of the cylindrical shell and is electrically disconnected with the cylindrical shell; such that when use, the zipper is pulled to drive the turning disk to rotate, and the dial block on the turning disk pushes a turned block to rotate and links the lever to rotate the rotating conductive rod synchronously, and an electric conduction between the rotating conductive rod and the first conductive plate and the second conductive plate is changed sequentially, so that the light emitting element is switched ON and OFF accordingly.

In the aforementioned zipper switch lampholder, the rotating conductive rod includes a positioning bump formed at the middle of the rotating conductive rod and abutted by the elastic element for assisting a positioning effect.

In the aforementioned zipper switch lampholder, a micro conductive notch is formed at a bent front end of the top end of the clamp plate for guiding the bare end of the power line to be plugged.

In the aforementioned zipper switch lampholder, each hook includes a vertical column integrally formed with the insulating base, a hook portion formed and extended outwardly from the top edge of the vertical column, and an assisting hook end formed and extended outwardly from the top edge of the vertical column and having a rear end protruded downwardly, so that when the power line is pushed across the assisting hook end to enter into the hook portion, the power line and the hook portion are connected securely.

DETAILED DESCRIPTION OF THE PREFERRED EMBODIMENTS

The technical characteristics and effects of the present invention will become apparent with the detailed description of preferred embodiments accompanied with the illustration of related drawings of the present invention as follows.

Figure 1:
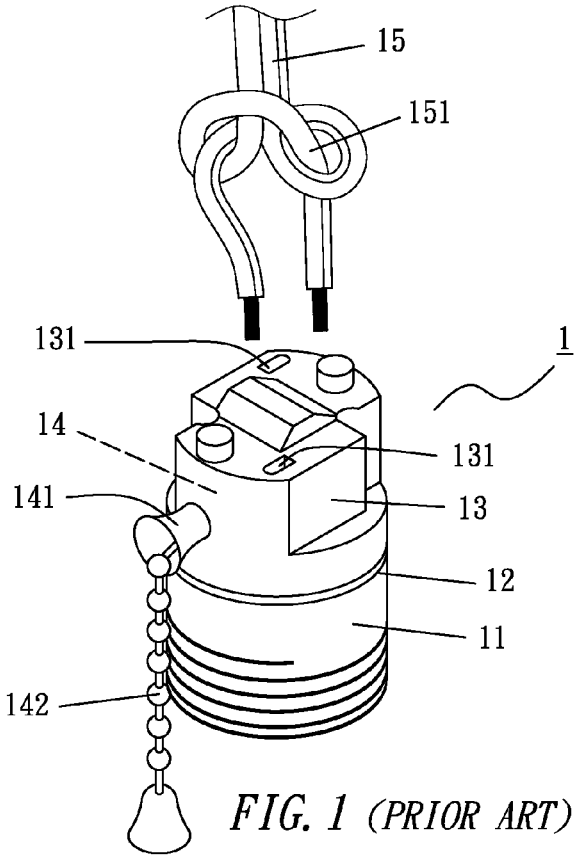
FIG. 1 (PRIOR ART)
FIG. 1 is a cross-sectional view of a conventional assembly tied with an UL knot.
Figure 2:
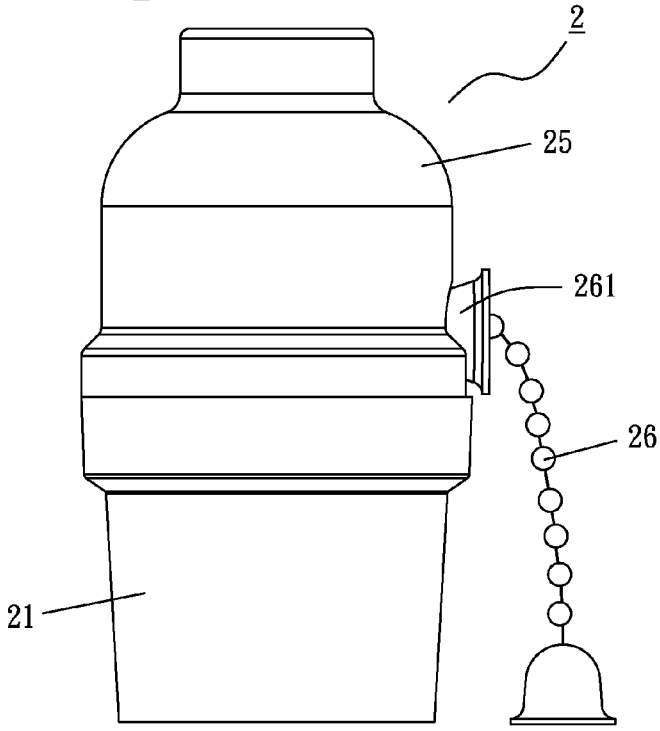
FIG. 2 is a front view of a preferred embodiment of the present invention.
Figure 3:
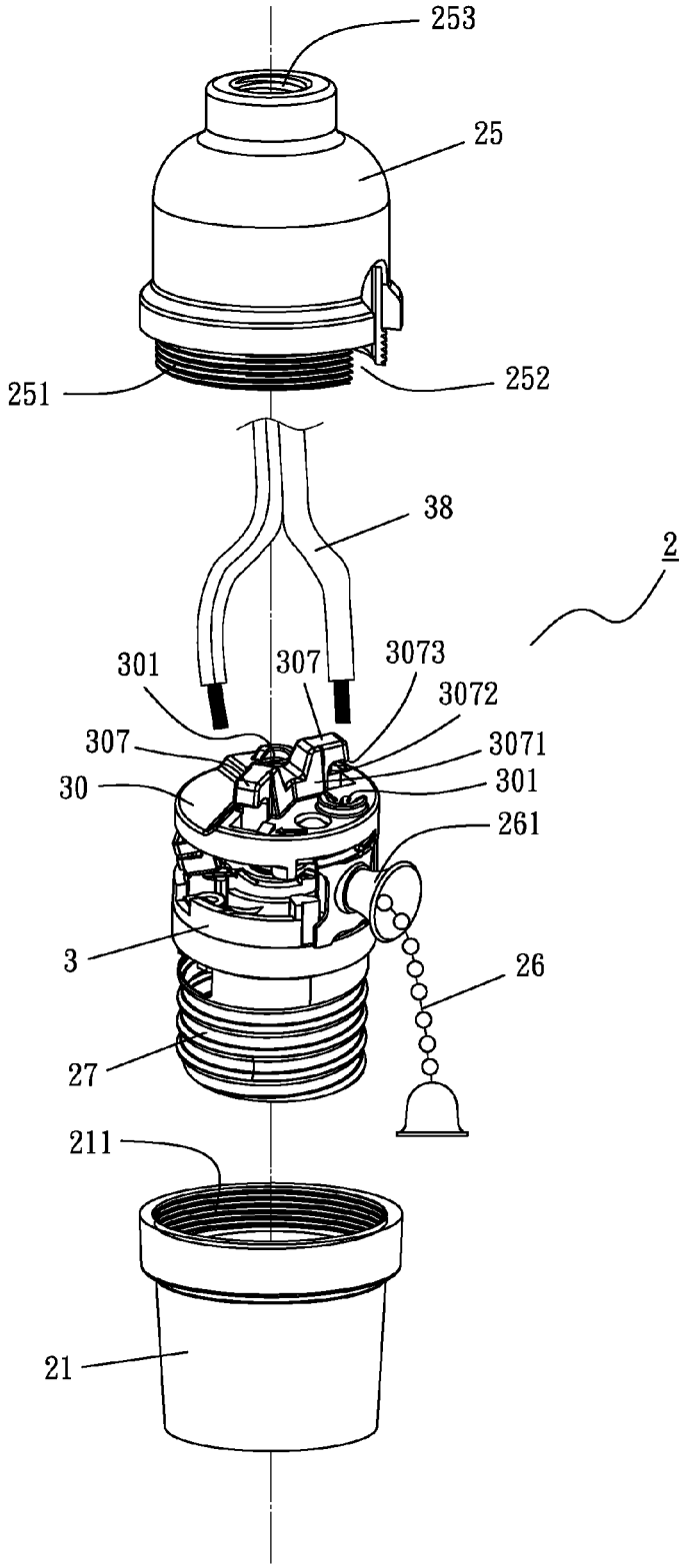
FIG. 3 is an exploded view of a major assembly of a preferred embodiment of the present invention.
Figure 4:
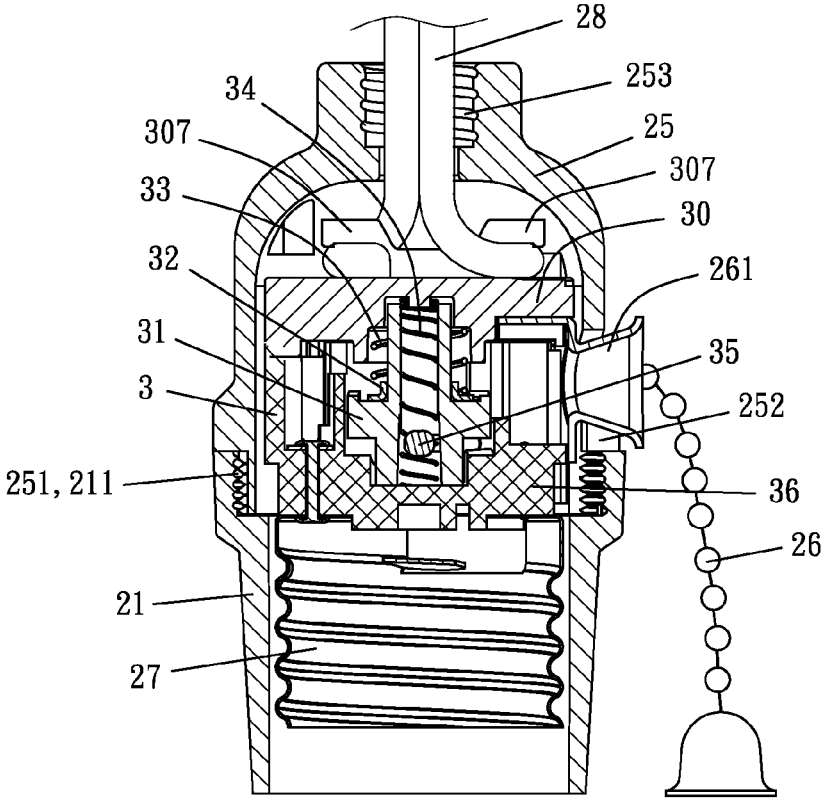
FIG. 4 is a cross-sectional view of a preferred embodiment of the present invention.

With reference to FIGS. 2 and 3 for a zipper switch lampholder in accordance with a preferred embodiment of the present invention, the zipper switch lampholder 2 comprises a housing 21, an operating member 3, a cap 25, a zipper 26, a trumpet base 261 and a cylindrical shell 27, wherein the bottom of the operating member 3 is coupled to the cylindrical shell 27 to jointly form an integral object, and the operating member 3 includes a switch mechanism therein, and the trumpet base 261 is fixed onto the operating member 3 and protruded to the outside, and the zipper 26 is coupled into the operating member 3 and drooped outwardly from the trumpet base 261; the cap 25 has an open bottom, a connecting portion 251 with an external thread formed on an external periphery of the bottom of the connecting portion 251, a slot 252 opened downwardly from the periphery, a through hole 253 with an internal thread and slightly tapered and formed at the top of the connecting portion 251, and the internal thread being provided for securing with a support element (not shown in the figure). The housing 21 has an open top and an open bottom, and the internal periphery of the top has a connecting portion 211 with an internal thread and secured with the connecting portion 251 of the cap 25. With reference to FIG. 4 for a major assembly, the operating member 3 and the cylindrical shell 27 are combined into an integral object which can be contained in the housing 21, and then the cap 25 is covered thereon, and the connecting portion 251 is secured with the connecting portion 211 of the housing 21, and the integral object formed by integrating the operating member 3 and the cylindrical shell 27 is contained therein. Now, the trumpet base 261 is passed out from the slot 252, and the zipper 26 is drooped outwardly from the trumpet base 261.

Figure 5:
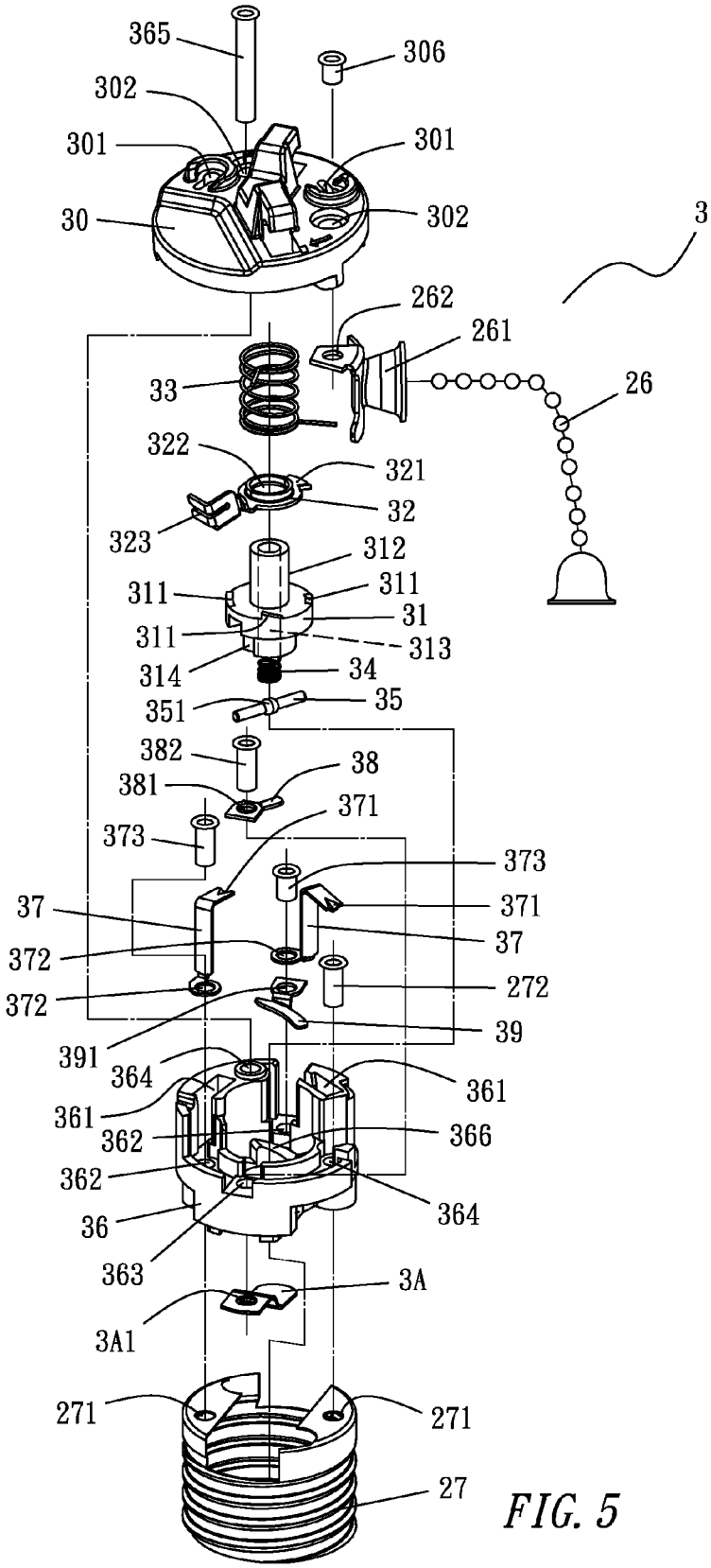
FIG. 5 is an exploded top view of major components of a preferred embodiment of the present invention.
Figure 6:
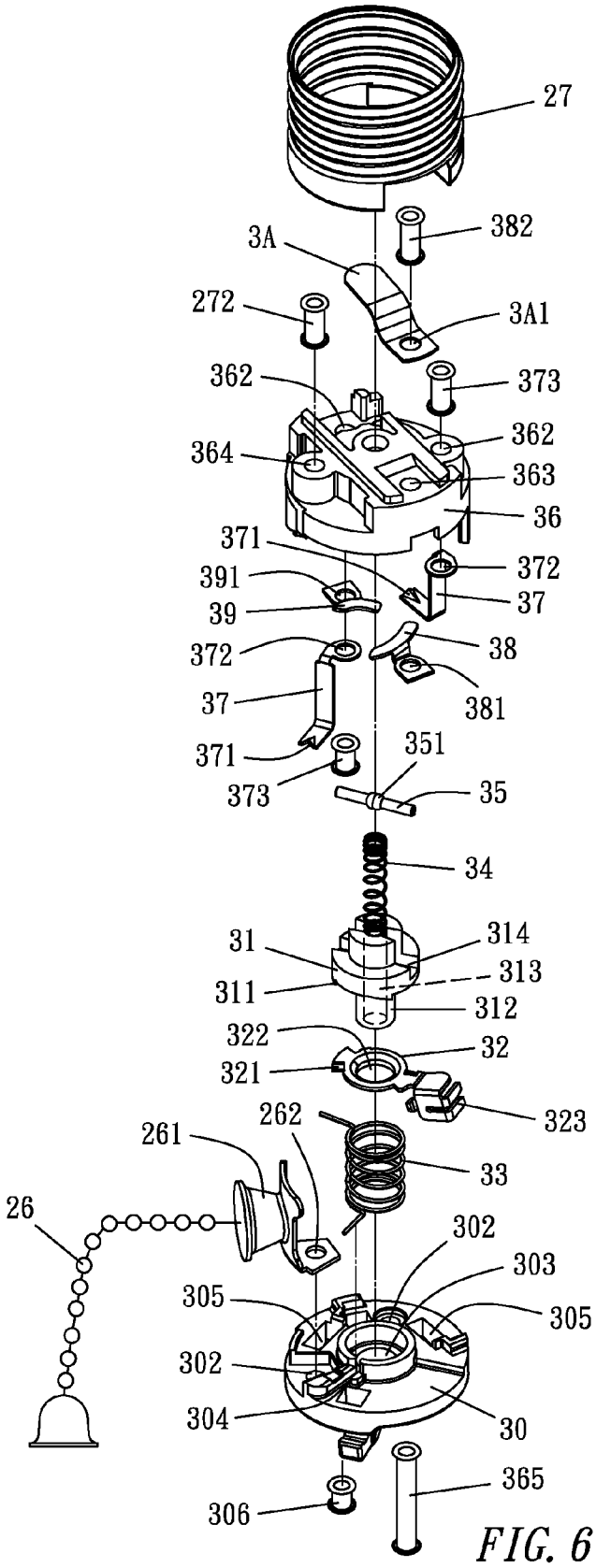
FIG. 6 is an exploded bottom view of major components of a preferred embodiment of the present invention.

With reference to FIGS. 5 and 6, the operating member 3 comprises the following elements:

An upper cover 30 has a plurality of plug wire holes 301, a plurality of connecting holes 302 and a plurality of hooks 307 formed at the top of the upper cover 30 and a middle containing groove 303, a positioning cavity 304 and a plurality of plate slots 305 penetrating through the plug wire holes 301 formed at the bottom of the upper cover 30. The trumpet base 261 includes a connecting hole 262 precisely aligned with one of the connecting holes 302, and then a connecting element 306 (such as a rivet) is provided and passed for a connection, so that the trumpet base 261 can be fixed to the upper cover 30 and protruded outwardly.

The hooks 307 are disposed at positions near the corresponding plug wire holes 301 respectively, and each hook 307 includes a vertical column 3071 integrally formed with the upper cover 30 to assure the required tensile resistance, and the vertical column 3071 has a hook portion 3072 extended outwardly from the top edge of the vertical column 3071, and a rear end protruded downwardly to form an assisting hook end 3073, so as to define a first interval between external surfaces of the hook portion 3072 and the upper cover 30 and a second interval b between external surface of the assisting hook end 3073 and the upper cover 3, wherein both of the first interval and the second interval are preferably smaller than the diameter of the power line 28, and the second interval is preferably smaller than the first interval.

A lever 31 has a main body and a plurality of turned blocks 311 with a slope and formed on slopes at the periphery of the top of the main body, an axial column 312 vertically erected from the center, a containing groove 313 formed at the bottom and penetrated upwardly to the top and a transverse groove 314 penetrated transversally, and the axial column is disposed at a position corresponding to a middle containing groove 303 of the upper cover 30.

A turning disk 32 has a dial block formed on a side and a passing hole 322 formed at the middle for sheathing on the axial column 312 of the lever 31, and a clamp groove 323 formed on the other side for passing an inner end of the zipper 26 through the trumpet base 261 to achieve a clamping effect.

A torque elastic element 33 (such as a torque spring) together with a passing hole 322 of the turning disk 32 are jointly sheathed on the axial column 312 of the lever 31, and then an end of the axial column 312 is inserted and installed into the middle containing groove 303 of the upper cover 30, and an end of the torque elastic element 33 abuts the turning disk 32, and the other end abuts a positioning cavity 304 of the upper cover 30 for a positioning effect.

An elastic element 34 (such as a strip spring) is contained in the containing groove 313 of the lever 31.

A rotating conductive rod 35 which is substantially a column shape, and has a positioning bump 351 formed at the middle of the rotating conductive rod 35, such that the rotating conductive rod can be abutted by the elastic element to assist the positioning effect, and during the assembling, the rotating conductive rod 35 compressed the elastic element 34 to retract into the containing groove 313 to accommodate the rotating conductive rod 35 into the transverse groove 314 and rotated with the lever 31 (as shown in FIG. 4).

Figure 9:
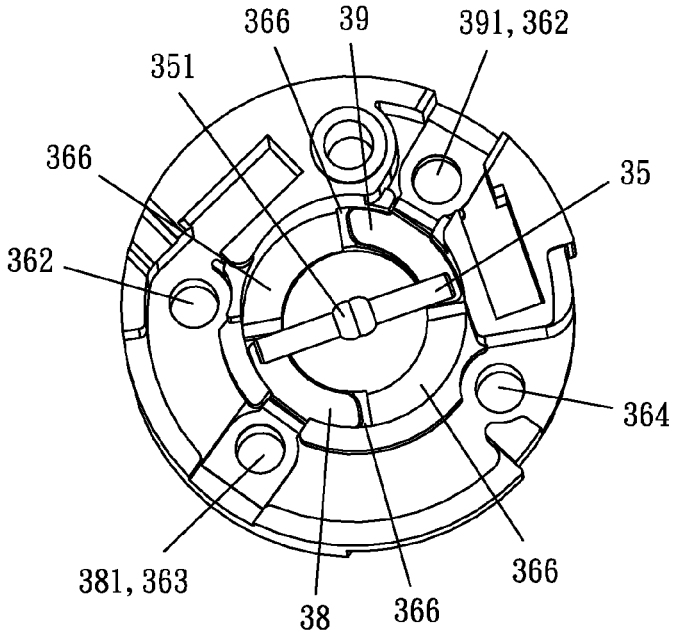
FIG. 9 is a schematic view of achieving the effect of switching on and off components in accordance with a preferred embodiment of the present invention.

A main body 36 has a plurality of long grooves 361 formed at the top of the main body 36 and corresponding to the plate slots 305 and the plug wire holes 301 of the upper cover 30, and each long groove 361 has a connecting hole 362 formed at a position proximate to the bottom of the long groove 361, and a connecting hole 363 and a plurality of fixing holes 364 are formed at the periphery of the main body 36. As described above, after the rotating conductive rod 35 compresses the elastic element 34 to retract into the containing groove 313 of the lever 31, and the rotating conductive rod 35 is accommodated into the transverse groove 314 of the lever 31. In other words, the bottom of the lever 31 together with the transversally built-in rotating conductive rod 35 are jointly plugged into a middle space (as shown in FIG. 4) in the main body 36, and the periphery of the middle space in the main body 36 has a slope 366 (as shown in FIG. 9) separately formed at a plurality of positions (such as four positions). However, after the following components are assembled (which will be described later), the upper cover 30 is covered onto the main body 36, so that another connecting hole 302 of the upper cover 30 is aligned precisely with one of the fixing holes 364, and then a connecting element 365 is passed for a secured connection.

Figure 7:
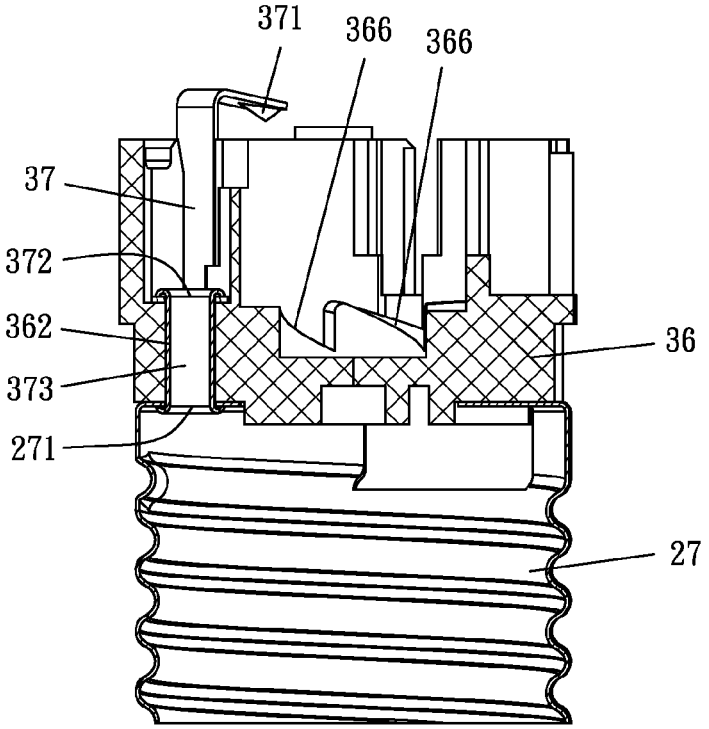
FIG. 7 is schematic view of some components of a preferred embodiment of the present invention.
Figure 8:
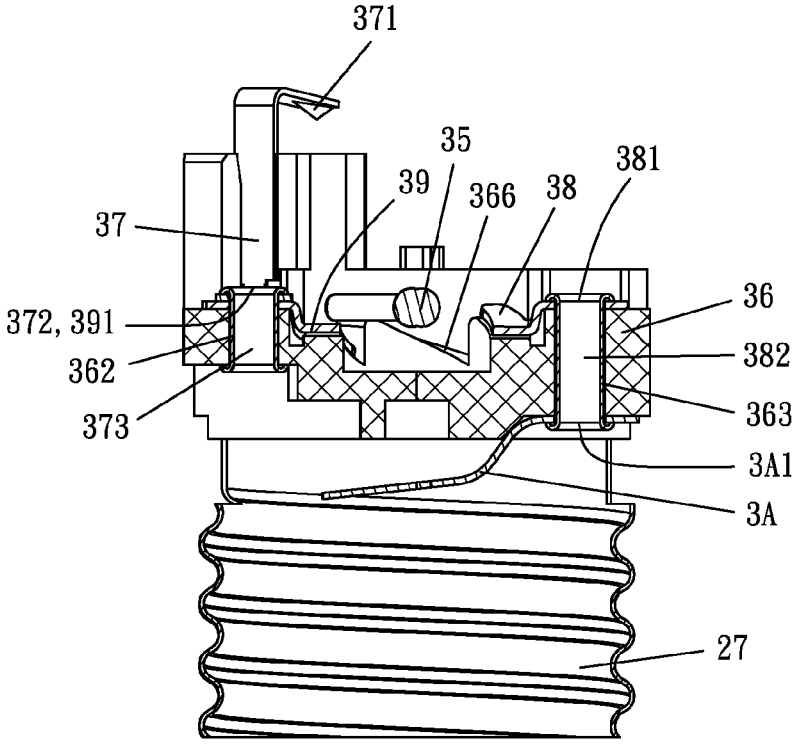
FIG. 8 is a schematic view of assembling some components of a preferred embodiment of the present invention.

A plurality of clamp plates 37 is contained in the long grooves 361 respectively, and the top end of each clamp plate 37 is bent to a substantially horizontal position and capable of being plugged into the plate slot 305 of the upper cover 30, and a micro conductive notch 371 is formed at a front end and a penetrating hole 372 is formed at a rear end and bent in an opposite direction, and both can be attached onto a connecting hole 362, and then a plurality of connecting elements 373 (such as rivets) can be passed for the connection (as shown in FIGS. 7 and 8).

A first conductive plate 38 is an oblique plate having a penetrating hole 381 formed on a side, and the top of the main body 36 is attached onto the connecting hole 363, and then a connecting element 382 (such as a rivet) is provided and passed for a connection (as shown in FIG. 8), so that the portion of the oblique plate of the first conductive plate 38 is tilted towards the center of the main body 36 and abutted against one of the slopes 366 obliquely.

A second conductive plate 39 is an oblique plate having a penetrating hole 391 formed on a side and included between the penetrating hole 372 and the connecting hole 362, so that the connecting element 373 can be passed sequentially through the penetrating hole 372, the penetrating hole 391 and the connecting hole 362 for a fixed connection (as shown in FIG. 8), and the second conductive plate 39 and a clamp plate 37 are always electrically conducted with each other, and the position of the oblique plate of the second conductive plate 39 is tilted towards the center of the main body 36 and abutted one of the other slopes 366 obliquely.

A third conductive plate 3A is a double bent plate having a penetrating hole 3A1, and the bottom of the main body 36 can be attached to the connecting hole 363, and aligned precisely with the penetrating hole 381 of the first conductive plate 38 with the connecting hole 363 in between, so that the connecting element 382 can be passed sequentially through the penetrating hole 381, the connecting hole 363 and the penetrating hole 3A1 for a fixed connection, and the third conductive plate 3A and the first conductive plate 38 are always electrically conducted with one another (as shown in FIG. 8).

With reference to FIGS. 5 to 9, the cylindrical shell 27 has an open bottom, and a threaded casing formed on the vertical wall for screwing a threaded end of a light emitting element (such as a bulb, which is not shown in the figures), and most of the tops are open and only the plates remain on both sides, and a penetrating hole 271 is formed at the top. During assembling, the top of the cylindrical shell 27 is attached onto the bottom of the main body 36, such that the penetrating holes 271 are aligned precisely and respectively with one of the connecting holes 362 and one of the fixing holes 364, so that after a connecting element 373 (such as a rivet) is passed through a penetrating hole 372 and a connecting hole 362, the connecting element 373 will pass through a penetrating hole 271 for a fixed connection, so that the cylindrical shell 27 and one of the clamp plates 37 are always electrically conducted with one another (as shown in FIG. 7), and after the other penetrating hole 271 is aligned precisely with a fixing hole 364, a connecting element 272 (such as a rivet) is provided and passed for a secured connection. After the assembling of the cylindrical shell 27 with the main body 36 is completed, a bent protruding portion of the third conductive plate 3A will stay at the open top of the cylindrical shell 27, so that the third conductive plate 3A and the cylindrical shell 27 are disconnected and situated at an OFF state (as shown in FIG. 8).

After the aforementioned components are assembled, the bare ends of the power line are plugged from the plug wire holes 301 respectively, and the bare ends are in contact with the micro conductive notches 371 of the clamp plates 37 respectively to achieve the effects of the connection and conducting the two electrodes of the power source to the clamp plates 37 respectively, and one of the electrodes is screwed to the cylindrical shell 27 through the penetrating hole 372 of the clamp plate 37, the, connecting element 373 and the penetrating hole 271 and the other electrode is conducted to the second conductive plate 39 through the penetrating hole 372 of the clamp plate 37 and the penetrating hole 391. A rear end of the power line 28 near the bare end is pushed into the corresponding hook 307. When the power line 28 is pushed across the assisting hook end 3073 to enter into the hook portion 3072 and inside the hook portion 3072, the power line 28 and the hook portion 3072 are abutted against one another to achieve the effect of securely fixing the power line 28 with the hook portion 3072, so as to achieve the wire connection between the wire switch lampholder 2 and the power line 28 to an extent that the power line 28 and the switch lampholder 2 cannot be loosened from each other easily.

Now, if the switch lampholder 2 is situated at the status as shown in FIG. 8, the rotating conductive rod 35 is situated between the first conductive plate 38 and the second conductive plate 39 and remains on the slope 366 without the first conductive plate 38 and the second conductive plate 39. In other words, the rotating conductive rod 35 is not in contact with the first conductive plate 38 and the second conductive plate 39, so that the current conducted to the second conductive plate 39 cannot be conducted to the first conductive plate 38, or to the third conductive plate 3A. Even if the terminal of the light emitting element is connected precisely into the cylindrical shell 27, the whole circuit is disconnected (OFF), and the light emitting element remains at an OFF status.

A user can pull the zipper 26 manually by hand to drive the turning disk 32 to rotate. During this process, the dial block 321 of the turning disk 32 pushes one of the turned blocks 311 to rotate, so that the whole lever 31 together with the rotating conductive rod 35 at the bottom are rotated synchronously. In the process, the rotating conductive rod 35 is simply rotated, so that both ends of the rotating conductive rod 35 is shifted upwardly from the original position stayed at the slope 366 without the first conductive plate 38 and the second conductive plate 39. When an end of the rotating conductive rod 35 pass through the peak of the slope 366, the end of the rotating conductive rod 35 instantly drops into the adjacent slope 366 having the first conductive plate 38 and the second conductive plate 39, so that the first conductive plate 38 and the second conductive plate 39 are conducted by the rotating conductive rod 35 instantly, and current flows to the third conductive plate 3A to turn on the whole circuit (ON) and light up the light emitting element instantly.

In the process of pulling the zipper 26 to drive the turning disk 32 to rotate, the torque elastic element 33 is compressed, so that as soon as the user releases the zipper 26, the resilience forces the turning disk 32 to resume its original position. The lever 31 is blocked by the raised wall at the bottom of the first conductive plate 38 and the second conductive plate 39 linked by the rotating conductive rod 35, so that both ends of the rotating conductive rod 35 remain at the lowest point of the slope having the conductive plates, and lever 31 also remains at that position as well.

If the user wants to turn off the light emitting element, the user simply needs to pull the zipper 26 by hand again, so as to turn the turning disk 32 to flip a turned block 311 to rotate the whole lever 31 and the rotating conductive rod 35 at the bottom synchronously. In the process, both ends of the rotating conductive rod 35 are moved upwardly along the first conductive plate 38 and the second conductive plate 39 and across the peak, and then falls into the adjacent slope 366 without the first conductive plate 38 and the second conductive plate 39 instantly, so as to disconnect the first conductive plate 38 from the second conductive plate 39 for an OFF state and turn off the light emitting element, and the rotating conductive rod 35 remains on the lowest point of the slope without the conductive plates and waits for another pull for the next operation.

In summation of the description above, the zipper switch lampholder of the present invention pulls a lever to rotate by a zipper and drive a rotating conductive rod, so that both ends of the rotating conductive rod can jump between a slope having a first conductive plate and a second conductive plate and a slope without the first conductive plate and the second conductive plate to achieve the effect of switching a light emitting element on and off. In addition, the zipper switch lampholder of the present invention provides a plurality of hooks for connecting a power line during a wire connection to waive the complicated process of tying an UL knot and provides a quicker and more convenient and secured wire connection.

While the invention has been described by means of specific embodiments, numerous modifications and variations of the link rod mechanism could be made thereto by those skilled in the art without departing from the scope and spirit of the invention set forth in the claims.

What is claimed is:

1. A zipper switch lampholder, comprising: a housing with an open top and an open bottom, and a connecting portion disposed at a top edge of the housing; an operating member, having a switch mechanism installed therein; a cylindrical shell, screwed and coupled to a bottom of the operating member and jointly contained in a housing, and a cylindrical shell bottom having an open bottom and a vertical wall which is a threaded casing provided for screwing and connecting a connector of a light emitting element, and a plate being installed separately on both sides of a vast majority of the open top, and each plate having a penetrating hole formed thereon; a trumpet base, having a connecting hole, fixed to an operating member and protruded towards the outside; a zipper, coupled into the operating member, and drooped outwardly from the trumpet base; and a cap, having an open bottom, a connecting portion formed at a bottom edge of the cap and coupled to the connecting portion at the top of the housing, a slot formed downwardly on a side of a periphery for passing the trumpet base out of the slot, and a through hole formed at the top for passing a power line and electrically coupling the operating member for an electric connection; characterized in that the operating member comprises:

an upper cover, having a plurality of plug wire holes, a plurality of connecting holes and a plurality of hooks disposed at the top of the upper cover, and a middle containing groove, a positioning cavity and a plurality of plate slots interconnected to the plug wire holes at the bottom of an upper cover, wherein a connecting hole is provided for precisely aligning the connecting hole of the trumpet base, and a connecting element is passed for a connection, such that the trumpet base is fixed to and protruded outwardly from the upper cover, and the plug wire holes are provided for plugging a plurality of bare ends of the power line respectively, and hooks disposed near the plug wire holes are provided for connecting the power line;

a lever, having a main body and a plurality of turned blocks with a slope and formed on slopes at the periphery of the top of the main body, an axial column vertically erected from a center of the main body, a containing groove formed at a bottom of the main body and penetrated upwardly to a top of the main body and a transverse groove penetrated transversally; an axial column, disposed at a position corresponding to a middle containing groove of the upper cover;

a turning disk, with a dial block formed on a side, and a passing hole formed at the middle, for sheathing on the axial column of the lever, and a clamp groove formed on the other side for passing an inner end of the zipper through the trumpet base to achieve a clamping effect;

a torque elastic element, together with a passing hole of the turning disk being jointly sheathed on the axial column of the lever, and then an end of the axial column being inserted and installed into the middle containing groove of the upper cover, and an end of the torque elastic element abutting the turning disk, and the other end abutting a positioning cavity of the upper cover for a positioning effect; an elastic element, contained in the containing groove of the lever;

a rotating conductive rod, being substantially a column shape, such that the rotating conductive rod compresses the elastic element to retract into the containing groove to accommodate the rotating conductive rod into the transverse groove and rotated with the lever;

the main body, having a plurality of long grooves formed at positions corresponding to the plate slots and the plug wire holes of the upper cover, and a connecting hole being formed at a position proximate to the bottom of the long grooves; the connecting hole and the plurality of fixing holes being formed at the periphery of the main body; after the rotating conductive rod compresses the elastic element to retract into the containing groove of the lever, and the rotating conductive rod is received into the transverse groove of the lever, the bottom of the lever together with the rotating conductive rod are jointly inserted into the middle space inside the main body; the main body includes a plurality of slopes formed around the middle space; the main body is covered by the upper cover, such that another connecting hole of the upper cover is aligned with one of the fixing holes and a connecting element is provided for the fixation;

a plurality of clamp plates, being contained in the long groove, and the top end being bent and abutted into a plate slot of the upper cover for plugging the bare end of the power line into the plug wire hole, and the bottom end being bent in an opposite direction, and having a penetrating hole attached onto a connecting hole, and then a plurality of connecting elements being passed for the connection;

a first conductive plate, being an oblique plate, and having a penetrating hole formed on a side, so that the top of the main body is attached onto the connecting hole, and then a connecting element being passed for the connection, and the position of the oblique plate being aligned towards the center of the main body and abutted against one of the slopes with an inclination;

a second conductive plate, being an oblique plate, having a penetrating hole formed on a side, and clamped between the penetrating hole of one of the clamp plates and the connecting hole, and the connecting element being passed for the connection, such that the clamp plate and the second conductive plate are always electrically conducted, and the oblique portion of the second conductive plate is tilted towards the center of the main body and abutted against a slope obliquely; and a third conductive plate, being a double-bent plate, and having a penetrating hole, and a connecting hole attached onto the bottom of the main body to align precisely with the penetrating hole of the first conductive plate with the connecting hole in between, and then the connecting element being passed for a fixed connection, so that the third conductive plate and the first conductive plate are always electrically conducted;

when the top of the cylindrical shell is attached onto the bottom of the main body, the penetrating hole formed at the top of the cylindrical shell is aligned precisely with a connecting hole and a fixing hole, and a penetrating hole is passed through the connecting element of the penetrating hole of one of the clamp plates for a fixed connection, such that the cylindrical shell and the clamp plate are always electrically conducted with each other; and after another penetrating hole is aligned precisely with the fixing hole, a connecting element is passed for a secured connection, so as to complete assembling the cylindrical shell with the main body; and a bent protruding position of the third conductive plate remains in the open space at the top of the cylindrical shell and is electrically disconnected with the cylindrical shell; such that when used, the zipper is pulled to drive the turning disk to rotate, and the dial block on the turning disk pushes a turned block to rotate and links the lever to rotate the rotating conductive rod synchronously, and an electric conduction between the rotating conductive rod and the first conductive plate and the second conductive plate is changed sequentially, so that the light emitting element is switched ON and OFF accordingly.

2. The zipper switch lampholder of claim 1, wherein the rotating conductive rod includes a positioning bump formed at the middle of the rotating conductive rod and abutted by the elastic element for positioning the conductive rod.

3. The zipper switch lampholder of claim 1, further comprising a micro conductive notch formed at a bent front end of the top end of the clamp plate for guiding the bare end of the power line to be plugged.

4. The zipper switch lampholder of claim 1, wherein each of the plural hooks includes a vertical column integrally formed with an insulating base, a hook portion formed and extended outwardly from a top edge of the vertical column, and an assisting hook end formed and extended outwardly from the top edge of the vertical column and having a rear end protruded downwardly, so that when the power line is pushed across the assisting hook end to enter into the hook portion, the power line and the hook portion are connected securely.

* * * * *